US010247458B2

(12) United States Patent
McGowan et al.

(10) Patent No.: US 10,247,458 B2
(45) Date of Patent: Apr. 2, 2019

(54) CHILLED WATER SYSTEM EFFICIENCY IMPROVEMENT

(71) Applicant: Carrier Corporation, Farmington, CT (US)

(72) Inventors: Christopher Shane McGowan, Marietta, GA (US); Steven Treece Tom, Acworth, GA (US)

(73) Assignee: CARRIER CORPORATION, Farmington, CT (US)

( * ) Notice: Subject to any disclaimer, the term of this patent is extended or adjusted under 35 U.S.C. 154(b) by 1200 days.

(21) Appl. No.: 14/463,817

(22) Filed: Aug. 20, 2014

(65) Prior Publication Data

US 2015/0052919 A1 Feb. 26, 2015

Related U.S. Application Data

(60) Provisional application No. 61/868,125, filed on Aug. 21, 2013.

(51) Int. Cl.
*F25B 49/00* (2006.01)
*F25B 25/00* (2006.01)

(52) U.S. Cl.
CPC ..... *F25B 49/005* (2013.01); *F25B 25/005* (2013.01); *F25B 2339/047* (2013.01); *F25B 2700/1351* (2013.01); *F25B 2700/21171* (2013.01)

(58) Field of Classification Search
CPC ..... F25B 49/005; F25B 25/005; F25B 2700/21171; F25B 2339/047; F25B 2700/1351
See application file for complete search history.

(56) References Cited

U.S. PATENT DOCUMENTS

| | | | | |
|---|---|---|---|---|
| 5,419,146 | A | 5/1995 | Sibik et al. | |
| 5,465,585 | A | 11/1995 | Mornhed et al. | |
| 5,573,181 | A | 11/1996 | Ahmed | |
| 5,600,960 | A | 2/1997 | Schwedler et al. | |
| 5,655,377 | A | 8/1997 | Mornhed et al. | |
| 5,669,225 | A | 9/1997 | Beaverson et al. | |
| 5,711,159 | A | 1/1998 | Whipple, III | |
| 5,946,926 | A * | 9/1999 | Hartman | F25D 17/02 236/25 A |
| 5,963,458 | A | 10/1999 | Cascia | |

(Continued)

*Primary Examiner* — Frantz Jules
*Assistant Examiner* — Steve Tanenbaum
(74) *Attorney, Agent, or Firm* — Cantor Colburn LLP

(57) ABSTRACT

Method for improving efficiency of a chilled water system having a chiller unit, circulation pumps, a heat absorption unit and a heat rejection unit, including adjusting a temperature of at least one of a chilled water supply to the heat absorption unit and a condenser water supply from the heat rejection unit; measuring efficiency of the chiller unit and at least one of the circulation pumps, the heat absorption unit and the heat rejection unit; further adjusting temperature of at least one of the chilled water supply to the heat absorption unit and the condenser water supply from the heat rejection unit if the measuring the efficiency indicates an improved efficiency; and further adjusting the temperature of the at least one of the chilled water supply to the heat absorption unit and the condenser water supply from the heat rejection unit if measuring the efficiency indicates worsened efficiency.

12 Claims, 6 Drawing Sheets

(56) References Cited

U.S. PATENT DOCUMENTS

| | | | |
|---|---|---|---|
| 6,318,065 | B1 | 11/2001 | Pierson |
| 6,470,686 | B2 | 10/2002 | Pierson |
| 6,505,475 | B1 | 1/2003 | Zugibe et al. |
| 6,637,229 | B1 | 10/2003 | Forrest et al. |
| 6,718,779 | B1 | 4/2004 | Henry |
| 6,732,540 | B2 | 5/2004 | Sugihara et al. |
| 6,769,258 | B2 | 8/2004 | Pierson |
| 6,785,592 | B1 | 8/2004 | Smith et al. |
| 6,848,267 | B2 | 2/2005 | Pierson |
| 6,973,410 | B2 | 12/2005 | Seigel |
| 6,976,366 | B2 | 12/2005 | Starling et al. |
| 6,990,821 | B2 | 1/2006 | Singh et al. |
| 7,059,143 | B1 | 6/2006 | Zugibe et al. |
| 7,086,240 | B1 | 8/2006 | Zugibe et al. |
| 7,246,500 | B2 | 7/2007 | Singh et al. |
| 7,343,746 | B2 | 3/2008 | Pierson |
| 7,349,824 | B2 | 3/2008 | Seigel |
| 7,533,536 | B1 | 5/2009 | Zugibe et al. |
| 7,567,888 | B2 | 7/2009 | Chang et al. |
| 7,599,759 | B2 | 10/2009 | Zugibe et al. |
| 7,644,591 | B2 | 1/2010 | Singh et al. |
| 7,805,952 | B1 | 10/2010 | Zugibe et al. |
| 7,845,183 | B2 | 12/2010 | Singh et al. |
| 7,890,215 | B2 | 2/2011 | Duncan |
| 7,894,943 | B2 | 2/2011 | Sloup et al. |
| 7,945,423 | B2 | 5/2011 | Seigel |
| 8,036,779 | B2 | 10/2011 | Ito et al. |
| 8,051,668 | B2 | 11/2011 | Singh et al. |
| 8,065,886 | B2 | 11/2011 | Singh et al. |
| 8,172,153 | B1 | 5/2012 | Kennedy et al. |
| 8,209,056 | B2 | 6/2012 | Rasmussen et al. |
| 8,219,250 | B2 | 7/2012 | Dempster et al. |
| 8,275,483 | B2 | 9/2012 | Higgins |
| 8,291,720 | B2 | 10/2012 | Hartman |
| 8,316,658 | B2 | 11/2012 | Singh et al. |
| 8,327,653 | B1 | 12/2012 | Zugibe et al. |
| 8,360,334 | B2 | 1/2013 | Nold et al. |
| RE44,079 | E | 3/2013 | Pierson |
| 8,396,572 | B2 | 3/2013 | Torzhkov et al. |
| 8,406,929 | B2 | 3/2013 | Duncan |
| 8,412,357 | B2 | 4/2013 | Seem |
| 8,417,392 | B2 | 4/2013 | Higgins |
| 8,418,483 | B2 | 4/2013 | McSweeney et al. |
| 8,448,459 | B2 | 5/2013 | McSweeney et al. |
| 8,459,053 | B2 | 6/2013 | Pham et al. |
| 9,261,542 | B1 * | 2/2016 | West ..... F25B 49/02 |
| 9,574,810 | B1 * | 2/2017 | West ..... F25B 49/02 |
| 2005/0192680 | A1 | 9/2005 | Cascia et al. |
| 2006/0117766 | A1 | 6/2006 | Singh et al. |
| 2006/0184326 | A1 * | 8/2006 | McNally ..... G01W 1/00 702/3 |
| 2009/0020173 | A1 | 1/2009 | Lau et al. |
| 2009/0090117 | A1 | 4/2009 | McSweeney |
| 2009/0094997 | A1 | 4/2009 | McSweeney |
| 2010/0094434 | A1 | 4/2010 | Ballet et al. |
| 2010/0145629 | A1 | 6/2010 | Botich et al. |
| 2011/0190946 | A1 * | 8/2011 | Wong ..... F24F 11/30 700/277 |
| 2011/0218683 | A1 | 9/2011 | Ben-Yaacov et al. |
| 2011/0276182 | A1 | 11/2011 | Seem et al. |
| 2011/0288687 | A1 | 11/2011 | Koyanagi et al. |
| 2011/0301766 | A1 | 12/2011 | Higgins et al. |
| 2012/0022700 | A1 * | 1/2012 | Drees ..... G05B 15/02 700/276 |
| 2012/0271462 | A1 | 10/2012 | Dempster et al. |
| 2012/0273581 | A1 | 11/2012 | Kolk et al. |
| 2012/0323637 | A1 | 12/2012 | Cushing et al. |
| 2013/0013121 | A1 | 1/2013 | Henze et al. |
| 2013/0030585 | A1 | 1/2013 | Rasmussen et al. |
| 2013/0047643 | A1 | 2/2013 | Higgins |
| 2013/0073094 | A1 | 3/2013 | Knapton et al. |
| 2013/0125565 | A1 | 5/2013 | Erpelding et al. |

* cited by examiner

CHILLED WATER SYSTEM EFFICIENCY IMPROVEMENT

CROSS-REFERENCE TO RELATED APPLICATIONS

This application claims the benefit of U.S. provisional patent application Ser. No. 61/868,125, filed Aug. 21, 2013, the entire contents of which are incorporated herein by reference.

BACKGROUND OF THE INVENTION

Embodiments relate generally to chilled water systems used in air conditioning systems, and more particularly to energy management of a chilled water system.

A common method to reduce chilled water system energy usage is to adjust (i.e., modify the operating set point) the chilled water supply temperature upwards and/or the condenser water supply temperature downwards (in systems having a water cooled condenser). Doing so can reduce overall energy usage. However, if one adjusts the temperatures too far, then energy usage can increase, rather than decrease. Existing chilled water energy management systems incorporate equipment modeling, and/or algorithms based in part on equipment modeling, to predict what chilled water and/or condenser water supply temperatures will result in the lowest energy use (expressed as efficiency in kW/ton). Modeling relies on specific chiller, pump, and fan power curves for the equipment in the chilled water plant. Each plant requires such custom data, and only with this data can the algorithms find the lowest energy usage throughout the day.

In any method dependent on modeling, finding the optimal efficiency is dependent on specific equipment data applied to a pristine system design. This locks a specific chilled water system to an ideal energy model. But chilled water systems do not remain pristine. They can change over time. The systems age, pipes foul and various components may be replaced. As the actual operating parameters depart from the model, the ability to reduce energy usage and improve efficiency is degraded.

SUMMARY

According to one aspect of the invention, a method for improving efficiency of a chilled water system having a chiller unit, circulation pumps and a heat absorption unit and a heat rejection unit, the method includes adjusting a temperature of at least one of a chilled water supply to the heat absorption unit and a condenser water supply from the heat rejection unit; measuring an efficiency of the chiller unit and at least one of the circulation pumps, the heat absorption unit and the heat rejection unit; further adjusting the temperature of at least one of the chilled water supply to the heat absorption unit and the condenser water supply from the heat rejection unit if the measuring the efficiency indicates an improved efficiency; and further adjusting the temperature of at least one of the chilled water supply to the heat absorption unit and the condenser water supply from the heat rejection unit if the measuring the efficiency indicates a worsened efficiency.

According to another aspect of the invention, a chilled water system includes a chiller unit having a compressor, condenser and evaporator; a heat absorption unit having a coil, a chilled water supply with circulation pump extending between the evaporator and the coil; a controller for executing operations including: increasing a temperature of the chilled water supply to the heat absorption unit; measuring an efficiency of the chiller unit and at least one of the circulation pump and the heat absorption unit; further increasing the temperature of the chilled water supply to the heat absorption unit if the measurement indicates an improved efficiency; decreasing the temperature of the chilled water supply to the heat absorption unit if the measurement indicates an worsened efficiency; measuring an efficiency of the chiller unit and at least one of the circulation pump and the heat absorption unit; further decreasing the temperature of the chilled water supply to the heat absorption unit if the measurement indicates an improved efficiency; and increasing the temperature of the chilled water supply to the heat absorption unit if the measuring the efficiency indicates an worsened efficiency.

According to another aspect of the invention, a computer program product, tangibly embodied on a non-transitory computer readable medium, for improving efficiency of a chilled water system having a chiller unit, circulation pumps, a heat absorption unit and a heat rejection unit, the computer program product including instructions that, when executed by a processor, cause the processor to perform operations including: adjusting a temperature of at least one of a chilled water supply to the heat absorption unit and a condenser water supply from the heat rejection unit; measuring an efficiency of the chiller unit and at least one of the circulation pumps, heat absorption unit and the heat rejection unit; further adjusting the temperature of at least one of the chilled water supply to the heat absorption unit and the condenser water supply from the heat rejection unit if the measuring the efficiency indicates an improved efficiency; and further adjusting the temperature of at least one of the chilled water supply to the heat absorption unit and the condenser water supply from the heat rejection unit if the measuring the efficiency indicates a worsened efficiency.

These and other advantages and features will become more apparent from the following description taken in conjunction with the drawings.

BRIEF DESCRIPTION OF THE DRAWINGS

The subject matter, which is regarded as the invention, is particularly pointed out and distinctly claimed in the claims at the conclusion of the specification. The foregoing and other features, and advantages of the invention are apparent from the following detailed description taken in conjunction with the accompanying drawings in which:

The detailed description explains embodiments of the invention, together with advantages and features, by way of example with reference to the drawings.

DETAILED DESCRIPTION OF THE INVENTION

Figure 1:
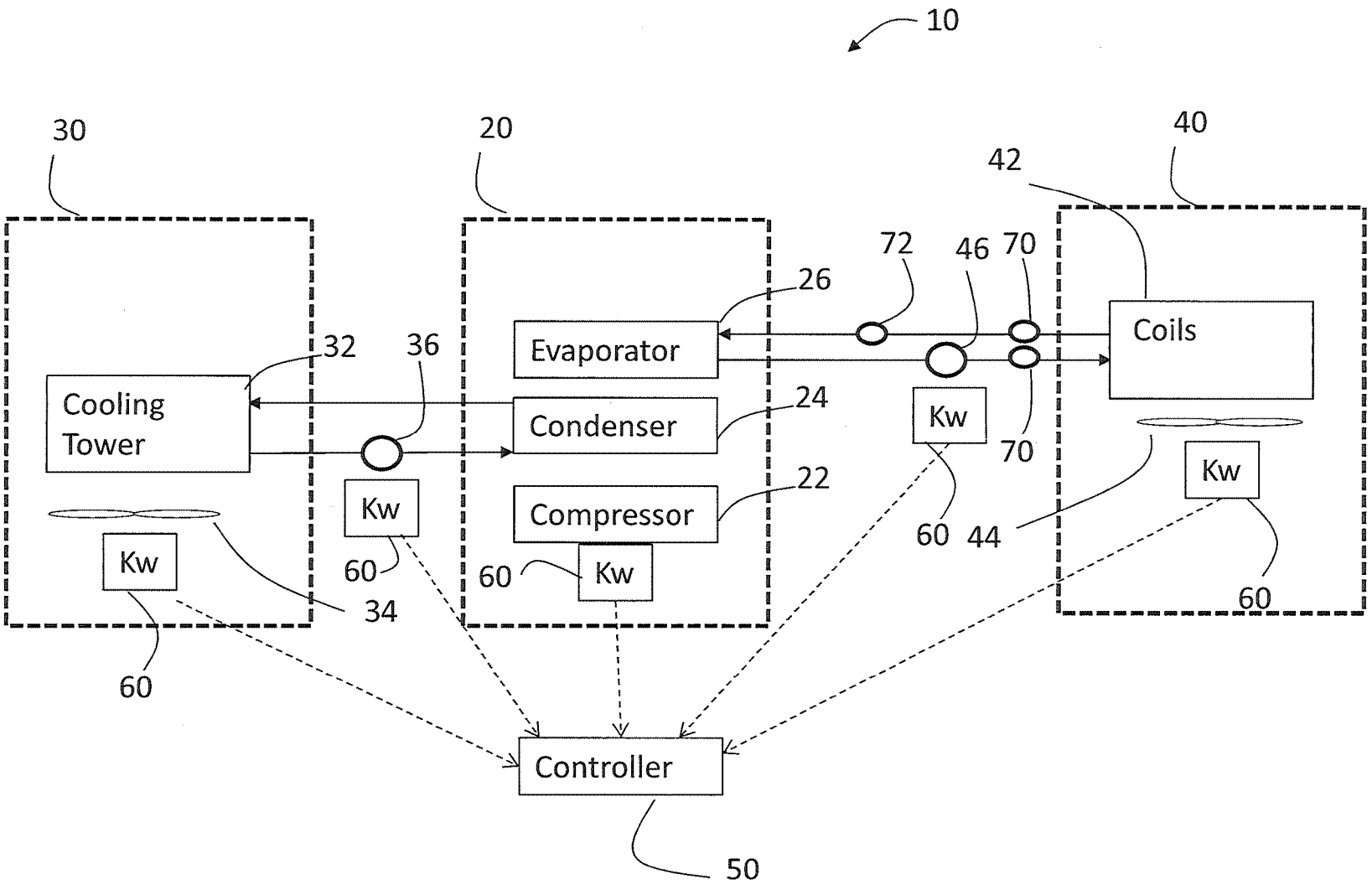
FIG. 1 depicts a chilled water system in an exemplary embodiment.

FIG. 1 depicts a chilled water system 10 in an exemplary embodiment. The embodiment of FIG. 1 is a simplified representation of a chilled water system, and it is understood that such systems may be more complex and include multiple pieces of equipment. Chilled water system 10 includes a chiller unit 20 having a compressor 22, condenser 24 and evaporator 26. As known in the art, condenser 24 receives pressurized, hot refrigerant from compressor 22. Refrigerant is condensed in condenser 24 through heat exchange with water from a heat rejection unit 30. Refrigerant is evaporated in evaporator 26 through heat exchange with water from a heat absorption unit 40.

The heat rejection unit 30 includes a heat exchanger 32 (e.g., a cooling tower) and at least one fan 34. Warm water in a heat exchange relationship with refrigerant in condenser 24 is circulated through heat exchanger 32, cooled, and returned to condenser 24. Fan 34 circulates air to improve cooling of the water. A circulation pump 36 is used to circulate water between condenser 24 and heat exchanger 32.

In alternate embodiments, the chilled water system 10 may have an air cooled chiller unit 20 instead of water cooled chiller unit. The air cooled chiller unit 20 is cooled by air fans mounted on the chiller to pass air over condenser 24. In such a system, the heat rejection unit 30 is not present.

The heat absorption unit 40 includes a heat exchanger 42 (e.g., coils) which may also include a fan 44, or a group of heat exchangers having fans. Cool water in a heat exchange relationship with refrigerant in evaporator 26 is circulated through heat exchanger 42, warmed, and returned to evaporator 26. Fan 44 circulates air across heat exchanger 42 and serves to provide supply air to a building, for example. A circulation pump 46 is used to circulate water between evaporator 26 and heat exchanger 42. A chilled water system 10 may include many heat absorption units 40, often in multiple buildings.

A controller 50 controls operation of the chilled water system 10 to reduce energy consumption. Controller 50 may be implemented using a general-purpose microprocessor executing a computer program stored on a storage medium to perform the operations described herein. Alternatively, controller 50 may be implemented in hardware (e.g., ASIC, FPGA) or in a combination of hardware/software. Controller 50 may also be part of a larger building HVAC control system.

A number of load sensors 60 are coupled to components of the chilled water system 10 to detect energy usage at each component. Load sensors may measure energy usage at compressor 22, fan 34, pump 36, fan 44 and pump 46. The load at each component may be determined based on kW consumed, based on current and voltage at each component.

Other sensors may be used in chilled water system 10. Temperature sensors 70 are positioned in the chilled water supply line and chilled water return line, entering and exiting heat exchanger 42, or group of heat exchangers, respectively. A flow meter 72 is positioned in a primary chilled water return line or supply line to measure fluid flow. The chilled water supply temperature, chilled water return temperature and chilled water flow rate through heat exchanger 42, or group of heat exchangers that make up the load on the building(s), are used to compute load in tons, as described in further detail herein.

Figure 2:
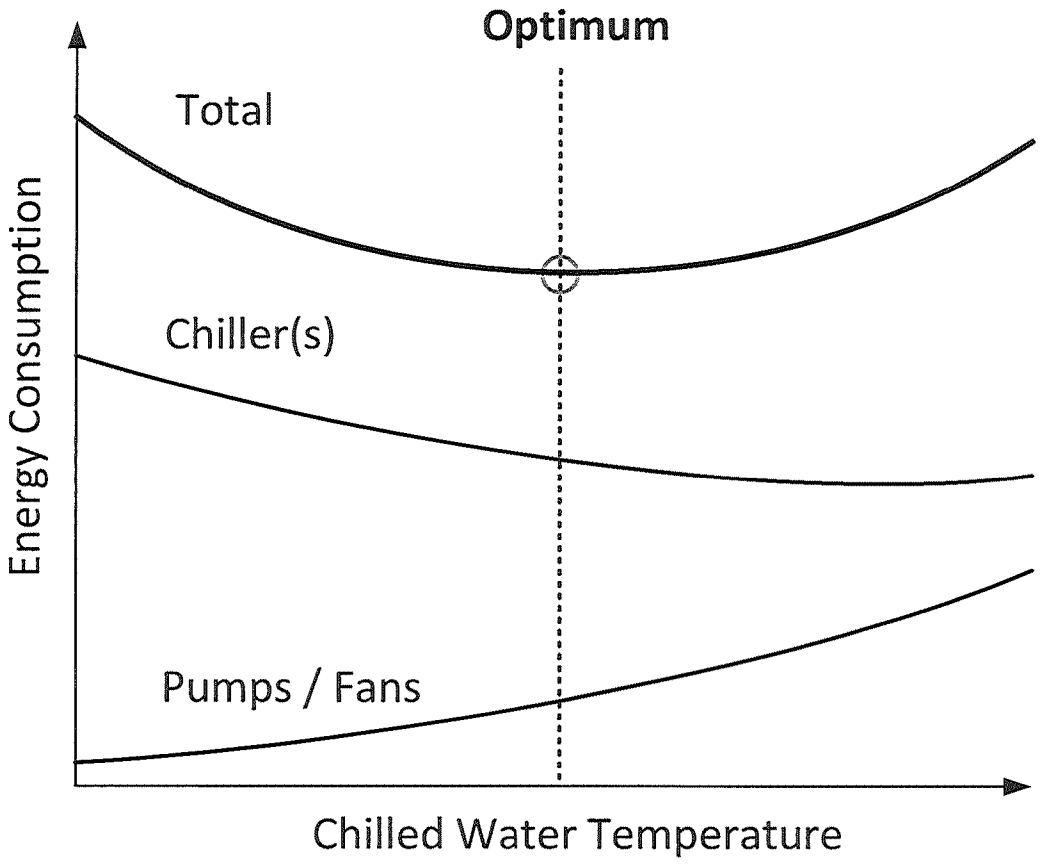
FIG. 2 is a plot of chilled water supply temperature versus energy consumption for various components and in total.

In operation of the chilled water system 10, controller 50 can adjust operating parameters to reduce energy consumption. One exemplary operating parameter is chilled water supply temperature. Increasing the chilled water supply temperature may result in reduced energy consumption by chiller unit 20. However, as the chilled water supply temperature increases, pump 46 and fan 44 may increase energy consumption as more water flow and more airflow are needed to meet the load. FIG. 2 depicts plots of energy consumption versus chilled water supply temperature. As shown in FIG. 2, the chiller unit 20 energy consumption decreases with increasing chilled water supply temperature. Energy consumption of pump 46 and fan 44 increase with increasing chilled water supply temperature. There is a point where the total energy consumption is a minimum. As described herein, controller 50 executes a method to operate the chilled water system 10 so that the total energy consumption is reduced.

The total energy consumption may be represented by kW/ton, which is an industry standard benchmark. This is often referred to as the efficiency of the chilled water system. A lower kW/ton means improved efficiency and lower overall energy usage. The kW portion is measured by totalizing the power usage of all the applicable chilled water system equipment. The ton portion of the equation is the total refrigeration load of the building, or cumulative load from multiple heat exchangers in multiple buildings. Referring to FIG. 1, the total load, or kW, can be expressed as a sum of the load from load sensors 60 as:

$$\Sigma kW = \Sigma \text{ compressor kW} + \Sigma \text{ Cooling Tower Fan kW} + \Sigma \text{ Condenser Water Pump kW} + \Sigma \text{ Chilled Water Pump kW} + \Sigma \text{ Coil Fan kW.}$$

The tons, the total refrigeration load of the building, may be represented as:

$$tons = (CHWF \times (CHWR - CHWS))/24;$$

where:

CHWF=Total Chilled Water Supply Flow feeding the building as measured in GPM (gallons per minute);

CHWR=Building Common Chilled Water Return Temperature as measured in degrees Fahrenheit; and CHWS=Building Common Chilled Water Supply Temperature as measured in degrees Fahrenheit.

Dividing total load by the refrigeration load gives the efficiency benchmark of kW/ton.

A common method to improve chilled water system efficiency, or to lower the kW/ton, is to adjust the chilled water supply temperature upwards and condenser water supply temperature downwards. This results in more efficient operation of chiller unit 20, as compressor 22 uses less power. If one adjusts the temperatures too far, then overall chilled water system energy usage can increase, rather than decrease, offsetting any efficiency obtained at the chiller unit 20.

Figure 3:
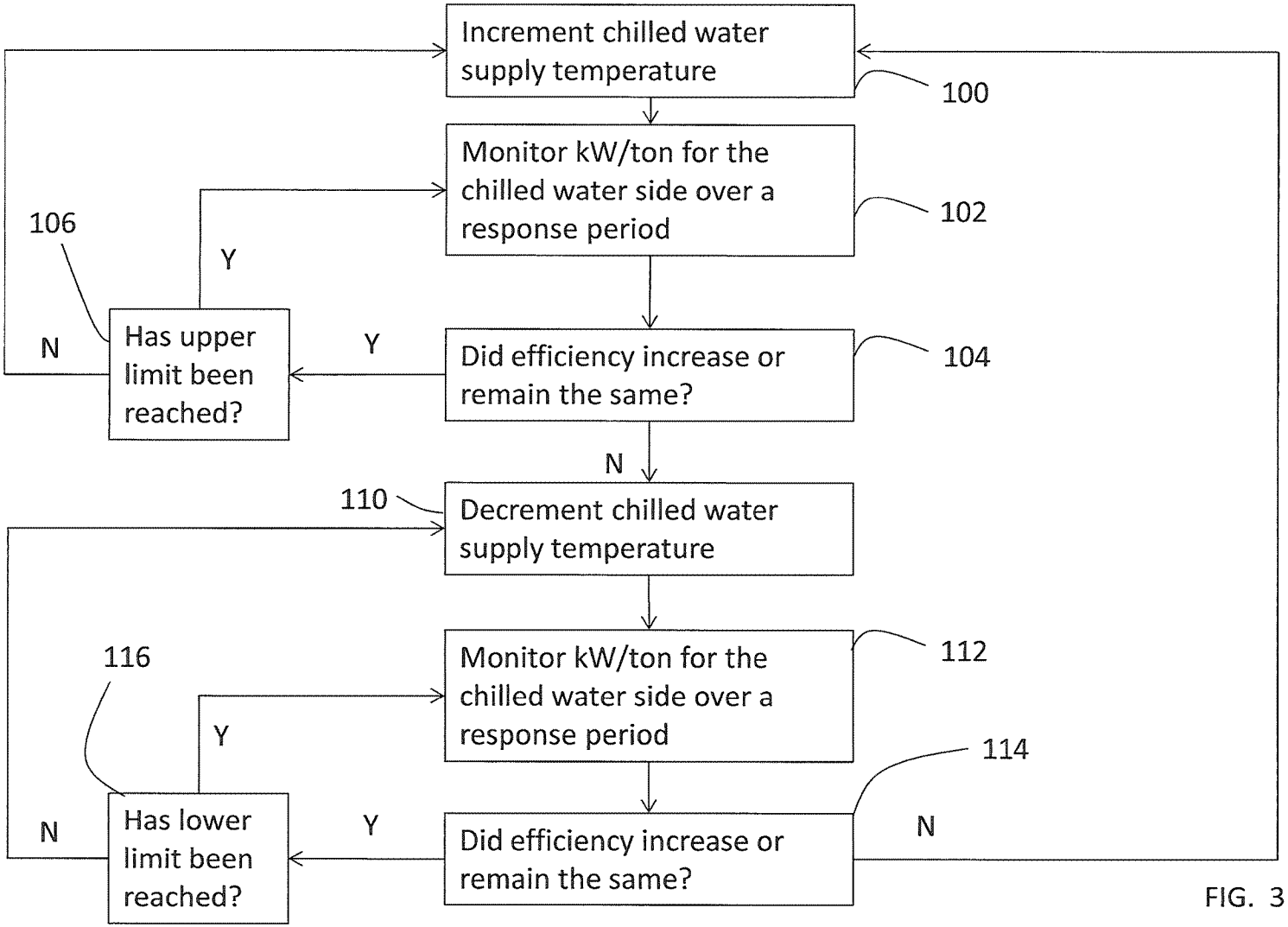
FIG. 3 is a flowchart of a process for improving energy efficiency in an exemplary embodiment.

FIG. 3 is a flowchart of a process executed by controller 50 to adjust the chilled water supply temperature for the chilled water side of chilled water system 10 and determine if that adjustment improves efficiency.

The process begins at 100, where controller 50 increases the chilled water supply temperature by a preset amount (e.g., 1 degree) from a starting set-point. At 102, controller 50 then periodically measures efficiency (kW/ton) for the chilled water side of chilled water system 10 (e.g., chiller unit 20 and the heat absorption unit 40) over a period of time, referred to as a response period. As noted above, load sensors 60 are used to obtain the kW measurements. The load measurements include components of the chiller unit 20 (e.g. compressor 22) and heat absorption unit 40 (e.g., pump 46 and fan 44), but not the heat rejection unit 30. The response period is determined by how long the chilled water system 10 needs to respond to and stabilize at the new chilled water supply temperature.

At 104, controller 50 determines if the efficiency increased or remained the same. This may be performed using a differential computation, described in further detail herein. If at 104, the efficiency has improved or remained the same, then flow proceeds to 106 where controller 50 determines if the chilled water supply temperature has reached an upper limit (e.g., 50 degrees F.). If the upper limit has been reached, then no reset is performed and the process simply repeats the measurement at 102.

If the upper limit is not reached, flow proceeds to 100, where the process will again incrementally raise the chilled water supply temperature upward by a calculated amount. Controller 50 will continue to raise the chilled water supply temperature until a predetermined upper limit is reached or the efficiency worsens.

If at 104 the efficiency worsens, this means that the higher adjusted chilled water supply temperature is creating inefficiencies. This is an indication that the chilled water system peripheral equipment, such as chilled water pumps 46 and air handling unit fans 44, are running faster and using more power at the higher adjusted temperature. Such power increases are offsetting any improvement in efficiency obtained at the chiller unit 20. If at 104 the efficiency worsens, flow proceeds to 110 where the chilled water supply temperature is decremented downwards.

At 112, controller 50 periodically measures efficiency (kW/ton) for the chilled water side of chilled water system 10 as described above with reference to 102. At 114, controller 50 determines if the efficiency increased or remained the same as described above with reference to 104. If at 114, the efficiency has improved or remained the same, then flow proceeds to 116 where controller 50 determines if the chilled water supply temperature has reached a lower limit. If the lower limit has been reached, then no reset is performed and the process simply repeats the measurement at 112.

If the lower limit is not reached, flow proceeds to 110, where the process will again decrement the chilled water supply temperature downward by a calculated amount. Controller 50 continues to decrement the chilled water supply temperature downwards until a lower limit is reached or the efficiency no longer improves on a decrement. This may be performed using a differential computation, described in further detail herein. Flow then proceeds to 100, where controller 50 begins incrementing the chilled water supply temperature.

Figure 4:
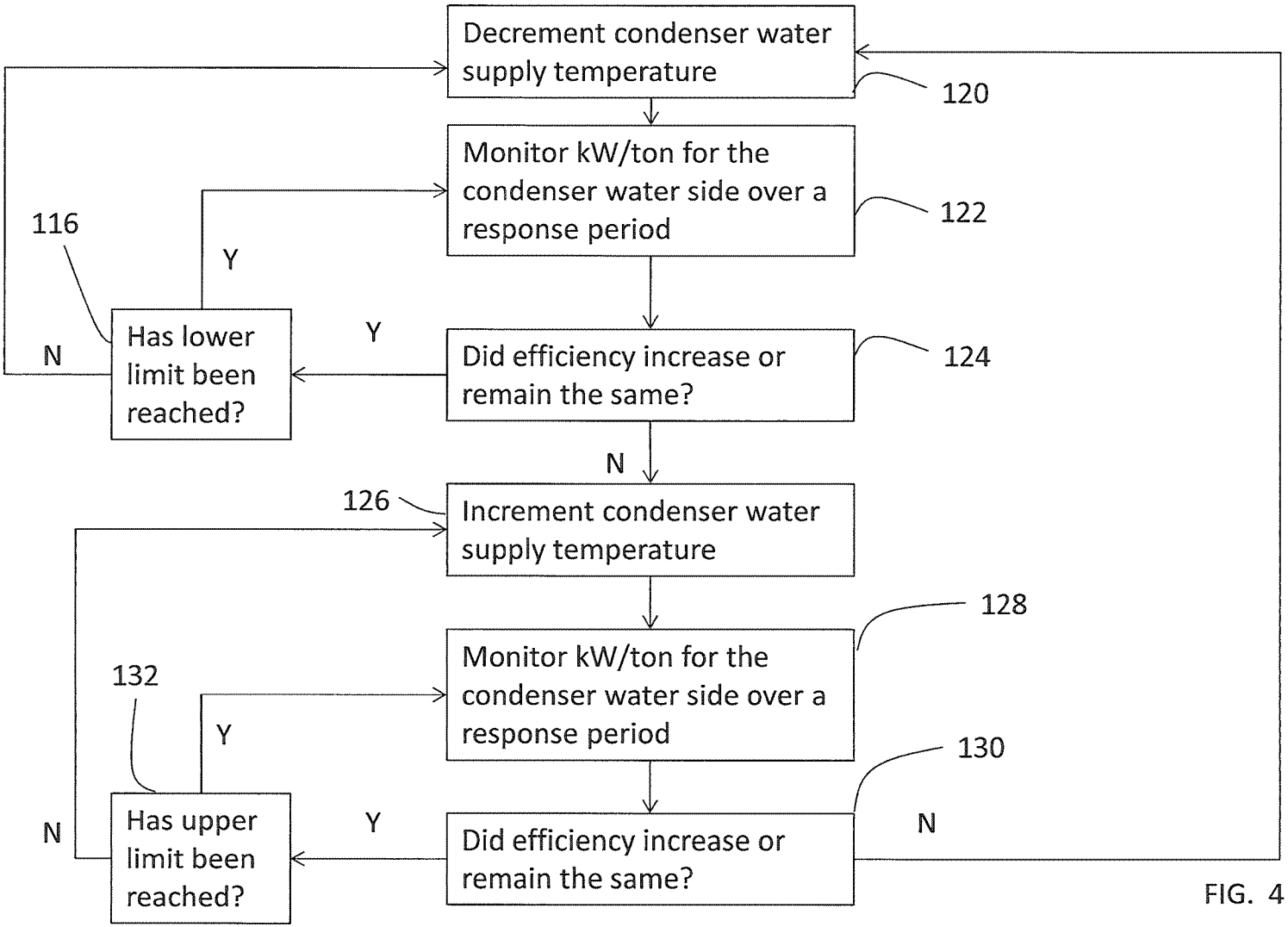
FIG. 4 is a flowchart of a process for improving energy efficiency in an exemplary embodiment.

As noted above, another technique to improve chilled water system efficiency in water cooled systems is to reduce the condenser water supply temperature. This results in compressor 22 consuming less electricity. If the chilled water system uses an air cooled chiller unit, then this process would not be employed. FIG. 4 is a flowchart of a process executed by controller 50 to adjust the condenser water supply temperature and determine if that adjustment improves efficiency. The control process of FIG. 4 may be used in conjunction with the control process of FIG. 3.

The process begins at 120, where controller 50 decreases the condenser water supply temperature by a preset amount (e.g., 1 degree) from a set-point. At 122, controller 50 then periodically measures efficiency (kW/Ton) for the condenser water side (e.g., heat rejection heat exchanger 30 and chiller unit 20) over a period of time, referred to as a response period. As noted above, load sensors 60 are used to obtain the kW measurements. The load measurements include components of the chiller unit 20 (e.g. compressor) and heat rejection unit 30 (e.g., pump 36 and fan 34), but not the heat absorption 40. The response period is determined by how long the chilled water system 10 needs to respond to and stabilize at the new condenser water supply temperature.

At 124, controller 50 determines if the efficiency increased or remained the same. This may be performed using a differential computation, described in further detail herein. If at 124, the efficiency has improved or remained the same, then flow proceeds to 126 where controller 50 determines if the condenser water supply temperature has reached a lower limit. If the limit has been reached, then no reset is performed and the process repeats the measurement at 122.

If the lower limit is not reached, flow proceeds to 120, where the process will again decrement the condenser water supply temperature downward by a calculated amount. Controller 50 will continue to decrease the condenser water supply temperature until a predetermined lower limit is reached or the efficiency worsens.

If at 124 the efficiency worsens, this means that the lower condenser water supply temperature is creating chilled water system inefficiencies. This is an indication that the heat rejection unit peripherals, such as water pump 36 and fan(s) 34, are running faster and using more power at the lower condenser water supply temperature. Such power increases are offsetting any improvement in efficiency obtained at the chiller unit 20. From 124, flow proceeds to 126 where the condenser water supply temperature is incremented upwards.

At 128, controller 50 periodically measures efficiency (kW/ton) for the condenser water side of chilled water system 10 as described above with reference to 122. At 130, controller 50 determines if the efficiency increased or remained the same as described above with reference to 124. If at 130, the efficiency has improved or remained the same, then flow proceeds to 132 where controller 50 determines if the condenser water supply temperature has reached an upper limit. If the upper limit has been reached, then no reset is performed and the process simply repeats the measurement at 128.

If the upper limit is not reached, flow proceeds to 126, where the process will again increment the condenser water supply temperature upward by a calculated amount. Controller 50 continues to increment the condenser water supply temperature upwards until the upper limit is reached or the efficiency no longer improves on an increment. This may be performed using a differential computation, described in further detail herein. Flow then proceeds to 120, where controller 50 begins decrementing the condenser water supply temperature.

The control processes of FIGS. 3 and 4 determine if chilled water system efficiency has increased or decreased. This determination may be made by determining a differential change in efficiency and determining if the differential change indicates increased or decreased efficiency. Two techniques may be used to determine the differential change in efficiency.

Figure 5:
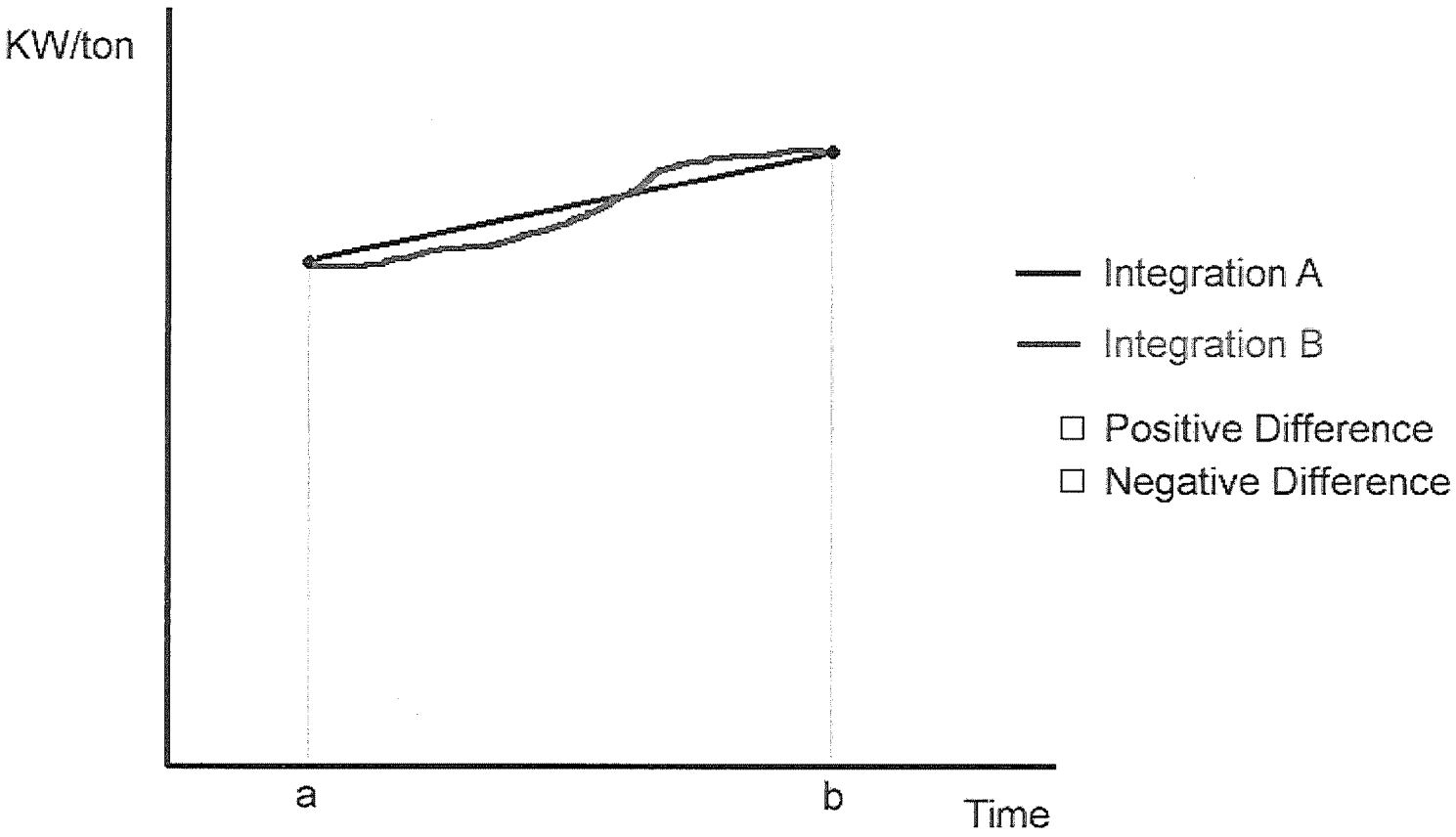
FIG. 5 illustrates detecting a differential change in efficiency in an exemplary embodiment.

A first method to determine the differential change in efficiency uses a point-to-point method to compare how the system might have performed without a temperature adjustment to how the system actually responds to the temperature adjustment. Referring to FIG. 5, controller 50 measures the efficiency in kW/ton at the very beginning (a) of the response period and also at the very end (b) of the response period. A linear representation is used to represent the efficiency between time (a) and time (b). The linear representation is formed by a line between the efficiency at time (a) and the efficiency at time (b). Controller 50 also measures the efficiency in kW/ton from the very beginning of the response period (a), and periodically over the entire period, to the very end of the response period (b). This is referred to as the actual efficiency from time (a) to time (b).

Controller 50 then integrates the linear representation of efficiency from time (a) to time (b) to derive a first integration, shown as integration A in FIG. 5. Controller 50 also integrates the actual efficiency from time (a) to time (b) to derive a second integration, shown as integration B in FIG. 5. The differential change in efficiency is determined as a difference between the first integration and the second integration, e.g., integration A–integration B. If this difference is positive, this means that the efficiency improved by adjusting the temperature. If this difference is negative, this means that the efficiency worsened by adjusting the temperature.

Figure 6:
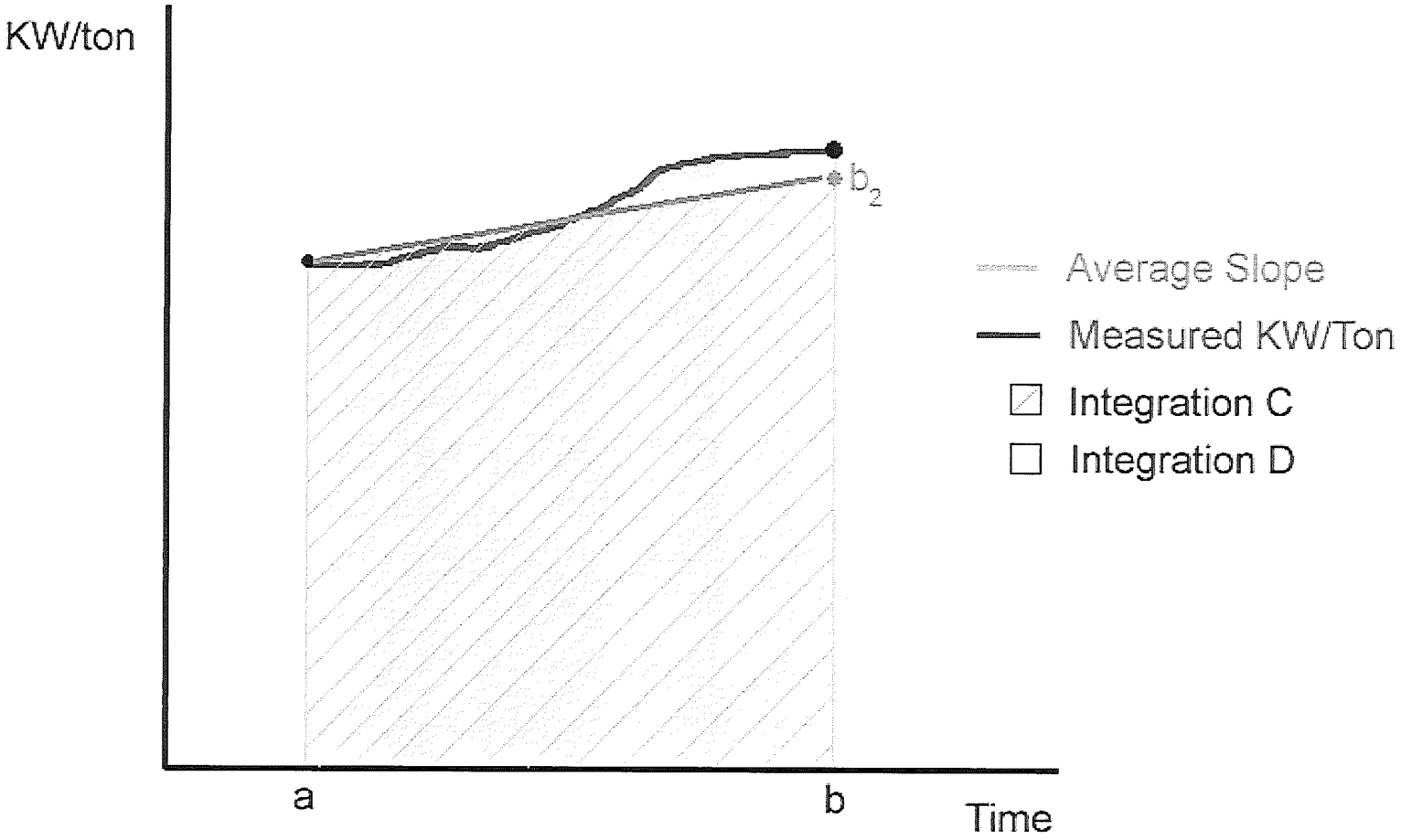
FIG. 6 illustrates detecting a differential change in efficiency in an exemplary embodiment.

An alternate embodiment uses a slope projection to derive the linear representation of efficiency from time (a) to time (b). This embodiment is illustrated in FIG. 6. Rather than using a straight line connecting the efficiency at time (a) and the efficiency at time (b), a line of best fit (e.g., using the least squared method) through all the measured efficiencies is used to define a straight line from time (a) to a projected end point at time (b). As in the embodiment of FIG. 5, controller 50 also measures the efficiency in kW/ton from the beginning of the response period at time (a), and periodically over the entire response period, to the end of the response period time (b).

Controller 50 then integrates the linear representation of efficiency from time (a) to time (b) to derive a first integration, shown as integration C in FIG. 6. Controller 50 also integrates the actual representation of efficiency from time (a) to time (b) to derive a second integration, shown as integration D in FIG. 6. The differential change is determined as a difference between the first integration and the second integration, e.g., integration C–integration D. If this difference is positive, this means that the efficiency improved by adjusting the temperature. If this difference is negative, this means that the efficiency worsened by adjusting the temperature.

The methods of determining the differential change in efficiency of FIGS. 5 and 6 may be used alone, or in combination. A first difference from FIG. 5 and a second difference from FIG. 6 may be combined to determine if the temperature adjustment is improving efficiency or not. If the combined result is positive, then that means the adjustment in temperature improved the efficiency and the process can again adjust the temperature in the same direction (i.e., if the previous temperature adjustment was upward, then the next adjustment can also be upward).

The chilled water system 10 of FIG. 1 is a representation of a chilled water system in a basic form. Embodiments may be applied to chilled water systems with multiple cooling towers, air cooled systems with no cooling towers, multiple condenser water pumps, multiple chilled water pumps, and multiple chillers. Embodiments may be applied to chilled water systems where secondary pumps as well as tertiary pumps are part of the chilled systems. Embodiments may also take into consideration any other energy consuming components as long as they are part of the chilled water system and used for cooling.

Embodiments do not rely on models to determine chiller efficiency. The supply temperatures that will reduce energy use are continually changing as the building load, outside air temperature, outside air humidity, and other factors change, and embodiments automatically adapt to these changes. Embodiments may be applied to a variety of chilled water systems and take into account the energy usage of the chillers, cooling towers, condenser water pumps and chilled water pumps. Embodiments also take into account the energy usage of air handling unit fans. Embodiments may be applied solely to adjustment of chilled water supply temperature, adjustment of condenser water supply temperature, or to both.

As described above, the exemplary embodiments can be in the form of processor-implemented processes and devices for practicing those processes, such as controller 50. The exemplary embodiments can also be in the form of computer program code containing instructions embodied in tangible media, such as floppy diskettes, CD ROMs, hard drives, or any other computer-readable storage medium, wherein, when the computer program code is loaded into and executed by a computer, the computer becomes a device for practicing the exemplary embodiments. The exemplary embodiments can also be in the form of computer program code, for example, whether stored in a storage medium, loaded into and/or executed by a computer, or transmitted over some transmission medium, loaded into and/or executed by a computer, or transmitted over some transmission medium, such as over electrical wiring or cabling, through fiber optics, or via electromagnetic radiation, wherein, when the computer program code is loaded into an executed by a computer, the computer becomes an device for practicing the exemplary embodiments. When implemented on a general-purpose microprocessor, the computer program code segments configure the microprocessor to create specific logic circuits.

The terminology used herein is for the purpose of describing particular embodiments only and is not intended to be limiting of the invention. While the description of the present invention has been presented for purposes of illustration and description, it is not intended to be exhaustive or limited to the invention in the form disclosed. Many modifications, variations, alterations, substitutions, or equivalent arrangement not hereto described will be apparent to those of ordinary skill in the art without departing from the scope and spirit of the invention. Additionally, while the various embodiments of the invention have been described, it is to be understood that aspects of the invention may include only some of the described embodiments and that various aspects of the invention, although described in conjunction with one exemplary embodiment may be used or adapted for use with other embodiments even if not expressly stated. Accordingly, the invention is not to be seen as being limited by the foregoing description, but is only limited by the scope of the appended claims.

The invention claimed is:

1. A method for improving efficiency of a chilled water system having a chiller unit, circulation pumps, a heat absorption unit and a heat rejection unit, the method comprising:

adjusting a temperature of at least one of a chilled water supply to the heat absorption unit and a condenser water supply from the heat rejection unit;

measuring an efficiency of the chiller unit and at least one of the circulation pumps, the heat absorption unit and the heat rejection unit;

further adjusting the temperature of at least one of the chilled water supply to the heat absorption unit and the condenser water supply from the heat rejection unit if the measuring the efficiency indicates an improved efficiency; and further adjusting the temperature of the at least one of the chilled water supply to the heat absorption unit and the condenser water supply from the heat rejection unit if the measuring the efficiency indicates a worsened efficiency;

wherein measuring the efficiency includes measuring the efficiency over a response period comprising determining a linear representation of the efficiency over the response period and determining the actual efficiency over the response period and integrating the linear representation of the efficiency over the response period and integrating the actual efficiency over the response period.

2. The method of claim 1 wherein:

adjusting a temperature includes comparing the temperature to a limit, and ceasing adjusting the temperature if the temperature exceeds the limit.

3. The method of claim 1 wherein:

measuring the efficiency includes determining a difference between the integration of the linear representation of the efficiency over the response period and the integration of the actual efficiency over the response period.

4. The method of claim 3 wherein:

wherein determining a difference between the integration of the linear representation of the efficiency over the response period and the integration of the actual efficiency over the response period includes subtracting the integration of the actual efficiency over the response period from the integration of the linear representation of the efficiency over the response period;

if the difference is positive, the efficiency improved in response to adjusting the temperature;

if the difference is negative, the efficiency worsened in response to adjusting the temperature.

5. The method of claim 1 wherein: determining the linear representation of the efficiency over the response period includes defining a line between an initial efficiency at a beginning of the response period and a final efficiency at an end of the response period.

6. The method of claim 1 wherein: determining the linear representation of the efficiency over the response period includes determining a best fit line through the actual efficiency over the response period.

7. The method of claim 1 wherein:

measuring the efficiency includes:

determining a first linear representation of the efficiency over the response period by defining a line between an initial efficiency at a beginning of the response period and a final efficiency at an end of the response period and determining the actual efficiency over the response period;

integrating the first linear representation of the efficiency over the response period and integrating the actual efficiency over the response period;

determining a first difference between the integration of the first linear representation of the efficiency over the response period and the integration of the actual efficiency over the response period;

determining a second linear representation of the efficiency over the response period includes determining a best fit line through the actual efficiency over the response period;

integrating the second linear representation of the efficiency over the response period and integrating the actual efficiency over the response period;

determining a second difference between the integration of the first linear representation of the efficiency over the response period and the integration of the actual efficiency over the response period; and combining the first difference and the second difference.

8. The method of claim 1 wherein:

adjusting the temperature includes increasing temperature of the chilled water supply to the heat absorption unit.

9. The method of claim 1 wherein:

adjusting the temperature includes decreasing temperature of the condenser water supply from the heat rejection unit.

10. The method of claim 1 wherein:

adjusting the temperature includes adjusting the temperature of both the chilled water supply to the heat absorption unit and the condenser water supply from the heat rejection unit.

11. A chilled water system comprising:

a chiller unit having a compressor, condenser and evaporator;

a circulation pump a heat absorption unit having a coil, a chilled water supply extending between the evaporator and the coil;

a controller configured to:

increase a temperature of the chilled water supply to the heat absorption unit;

measure an efficiency of the chiller unit, circulation pump and the heat absorption unit;

further increase the temperature of the chilled water supply to the heat absorption unit if the measurement indicates an improved efficiency;

decrease the temperature of the chilled water supply to the heat absorption unit if the measurement indicates an worsened efficiency;

measure an efficiency of the chiller unit, circulation pump and the heat absorption unit;

further decrease the temperature of the chilled water supply to the heat absorption unit if the measurement indicates an improved efficiency; and increase the temperature of the chilled water supply to the heat absorption unit if the measuring the efficiency indicates an worsened efficiency;

wherein measuring the efficiency includes measuring the efficiency over a response period comprising determining a linear representation of the efficiency over the response period and determining the actual efficiency over the response period and integrating the linear representation of the efficiency over the response period and integrating the actual efficiency over the response period.

12. The chilled water system of claim 11 further comprising:

a heat rejection unit;

the controller for executing operations including:

decreasing a temperature of a condenser water supply from the heat rejection unit;

measuring an efficiency of the chiller unit, circulation pump and the heat rejection unit;

further decreasing the temperature of the condenser water supply from the heat rejection unit if the measurement indicates an improved efficiency; and increasing the temperature of the condenser water supply from the heat rejection unit if the measurement indicates an worsened efficiency;

measuring an efficiency of the chiller unit, circulation pump and the heat rejection unit;

further increasing the temperature of the condenser water supply to the heat rejection unit if the measurement indicates an improved efficiency; and increasing the temperature of the condenser water supply to the heat rejection unit if the measurement indicates an worsened efficiency.

* * * * *